United States Patent [19]

Justus

[11] Patent Number: 4,655,066

[45] Date of Patent: Apr. 7, 1987

[54] DEVICE FOR STRAIGHTENING COLD-DEFORMABLE, ROTATIONALLY-SYMMETRICAL WORKPIECES

[76] Inventor: Erhard Justus, Guentersteiner Weg 22, D-6313 Homberg, Fed. Rep. of Germany

[21] Appl. No.: 813,108

[22] Filed: Dec. 24, 1985

[30] Foreign Application Priority Data

Jan. 9, 1985 [DE] Fed. Rep. of Germany ..... 3500481

[51] Int. Cl.[4] ..... B21D 3/02

[52] U.S. Cl. ..... 72/90; 72/94

[58] Field of Search ..... 72/88–90, 72/110, 365, 111, 385, 94; 140/147

[56] References Cited

U.S. PATENT DOCUMENTS 1,058,856 4/1913 Gibbs ..... 72/89

3,645,119 2/1972 Berg et al. ..... 72/90

FOREIGN PATENT DOCUMENTS 41685 12/1971 Japan ..... 72/110

*Primary Examiner*—Daniel C. Crane

*Attorney, Agent, or Firm*—Jordan and Hamburg

[57] ABSTRACT

A device is described for straightening rotationally symmetrical, cold-deformable workpieces, wherein these workpieces are deflected between bearing and straightening points as far as the plastic stress region. The workpieces are simultaneously set in rotation and then, during the rotational movement, the deflection is continuously removed again. The invention is characterized in that the workpieces are guided between a stationary bearing surface and stationary upper rails, the workpieces being gripped between pairs of rollers which form a prismatic gripping device and roll on the bearing surface, the workpieces simultaneously travelling in the pairs of rollers and along the upper rails and thereby being simultaneously deflected. It can be acheived in a very short time because a plurality of pairs of rollers, each of which grips one particular workpiece, are continuously guided in one direction between the bearing surface and the upper rails behind one another with a spacing therebetween. In addition, the use of freely rotating rollers easily permits even components with considerably stepped diameters to be straightened. A fully automatic operation is easily possible, whereby the described device is achieved with only a few moving component parts.

11 Claims, 5 Drawing Figures

DEVICE FOR STRAIGHTENING COLD-DEFORMABLE, ROTATIONALLY-SYMMETRICAL WORKPIECES

The invention relates to a device for straightening cold-deformable, rotationally-symmetrical workpieces, such as axles, shafts, bolts and the like.

It is known that, in industrial production, workpieces are often required to be straight, but this cannot be guaranteed by the selected manufacturing process. This is particularly true relative to slim objects which are subjected to a heat-treatment, such as annealing, tempering or hardening, or objects which are re-shaped without leaving chips. It is then necessary to straighten these objects subsequently.

Provided that these objects are rotationally-symmetrical, i.e. they are shafts, axles, pins, bolts, and the like, and provided that they have an adequate degree of plastic deformability, it is usual practice to straighten the workpieces by means of machines or automatic machines which operate according to the so-called dynamic roller-straightening process.

Because the workpiece additionally rotates during deflection to just above the elasticity limit, each circumferential point alternately reveives plastictensile and compressive stress at the straightening locations. As a result, the stress amplitudes occurring because of the original curvature of the workpiece are equalised at the straightening locations after a few revolutions. Because of the subsequent, continuous removal of deflection and hence the removal of the bending stress during rotation at the elastic region again, the axial centres of the supporting locations and of the straightening locations of the workpiece are centred upon a common axis, the dimension of the return stroke per revolution during transition from the plastic to the elastic bending stress region is, inter alia, crucial for the size of the remaining residual recoil, i.e. the smaller the return stroke per revolution at this moment, the better is the straightening result, measured at the supporting and straightening points.

In order to keep the deviations from straightness within the actually required limits, and even those deviations occurring between the individual straightening points, it may be necessary for very slim objects, for example, to increase the number of straightening locations and accordingly to reduce their spacing between one another.

Known machines of this type may largely operate according to two different embodiments:

In the first embodiment, the workpiece is clamped at one end in a stationary spindle and set in rotation by the drive of the spindle. Subsequently, the workpiece is deflected to a fixedly set extent by means of at least one straightening rod which moves perpendicularly relative to the rotational axis. To transfer the deflection force to the rotating workpiece, this rod usually has two freely rotating rollers which are disposed opposite each other with a radial spacing therebetween, but the transfer may also be effected by a pressure plate which is made from a slidable material and possibly has a prismatic shape. In the simplest case, the workpiece is only supported by the spindle which tensions the workpiece. However, additional supporting points may be provided, such points being disposed opposite the straightening rods and being offset with an axial spacing therebetween, the supporting forces being transferred to the rotating workpiece in an identical manner to that used for the straightening rods. The continuous removal of deflection is usually effected by the return stroke movement of the straightening rods, such movement being adjustable in respect of its speed.

A significant disadvantage of this embodiment resides in the fact that the required torque is only introduced into the workpiece from one location. Since, during the straightening process with a plurality of straightening locations, the required indiviual torques of the straightening locations are added to this tensioning location, the torsional stresses which are superimposed on the bending stresses may easily result in a plastic distortion of the workpiece behind the tensioning location or at the subsequent straightening location, and may accordingly result in the destruction of said workpiece. An additional disadvantage resides in the relatively long cycle time which results from the sequential mode of operation (introducing workpiece into spindle, tensioning, setting in rotation, advancing straightening rods, returning straightening rods in a precision stroke, releasing tension and extracting workpiece from spindle). This embodiment also requires a considerable amount of mechanical and control-technological outlay. It is apparent that a reduction in the return stroke speed, as required to increase quality, extends the cycle time, as does a desirable measurement monitoring of the straightening result directly in the machine.

In the second known embodiment of this type, at least two lower rails are disposed adjacent to one another, such rails extending parallel to each other with a spacing therebetween and having at least one upper rail disposed opposite thereto with a predetermined spacing therebetween, said upper rail being disposed between the lower rails and extending parallel thereto. The upper rails are stationary, whereas the lower rails are mounted on a carriage which is displaceable in the direction of the rails.

In the initial position, the rear portions of the lower rails are disposed beneath the front portions of the upper rails. The workpiece is introduced between the upper and lower rails transversely thereto. Subsequently, by lowering the upper rails, the spacing between the upper rails and lower rails is reduced by the lowering of the upper rails in such a manner that the workpiece is deflected by a fixedly set extent. The carriage, together with the lower rails, is now forwardly displaced, whereby the workpiece travels along the upper rails and on the lower rails and moves forwardly at half the speed of the carriage and over half the distance of travel of the carriage. Since the spacing between the rear edges of the upper rails and the front edges of the lower rails is greater by a predetermined extent than the spacing between the front edges of the upper rails and the rear edges of the lower rails, the deflection of the workpiece continuously decreases again with the increase of forward movement of the carriage. After the stroke has ended, the workpiece is released by raising the upper rails, and the carriage, together with the lower rails, moves back again into its initial position.

Variations of this embodiment are also conceivable, wherein there is no lowering of the upper rails at the beginning of the stroke and no raising at the end of the stroke. Instead, at the beginning of the stroke, the workpiece is pressed by an additionally driven ram between the rails over a flat inclined inlet, so that it is gripped by said rails and drawn-in due to frictional contact.

Machines according to this second embodiment are disdvantageous, in that the required empty return stroke of the carriage and the reversal of the direction of travel of the component parts are detrimental to providing a short cycle time.

In particular, howver, it is difficult and laborious when it is desirable to straighten objects which do not have uniform diameters at the fixed straightening or supporting points. Because of the variable rolling circumference, the objects travel obliquely, and this phenomenon could only be prevented by using complex, additional guide carriages which advance at half the speed of the rail carriage. If there is a considerable difference in diameter, it would be additionally necessary to dispose the appropriate straightening rail in an axially and freely displaceable manner, so that the equalising slip and hence the wear do not become excessive, but considerable mechanical outlay is associated therewith.

The torque required to rotate the workpiece is applied by the frictional contact between the workpiece surface and the rail surface, the limit for the transferable torque accordingly being formed by the frictional value, the deflection force and the spacing between the upper and lower rails.

A reduction in the removal of deflection per revolution, as required to increase quality, or a measurement monitoring of the straightening result directly in the machine, necessitates a relatively long travel distance. Since the stroke of the rail carriage needs to be twice as long as the travel distance, though a long stroke demands a high mechanical outlay but especially an extension of the cycle time, only relatively short travel distances are economically viable.

The empty return stroke of the rail carriage extends the cycle time and is precluded, in a particular variation of this embodiment, because the oscillating linear movement of the rail carriage is replaced by the rotating movement of a drum which supports the lower rails which, in this case, are quasi endless and are in the form of circular discs. The upper rails are formed by circular ring segments which are disposed coaxially relative to the drum.

It is true that this arrangement permits a continuous operation and a shortening of the cycle time but, in addition to the disadvantages already mentioned, there is also the additional, considerable disadvantage concerning the complicated, circular upper rails which are expensive to manufacture and difficult to regrind, the radius of curvature of said upper rails having to be adapted to the particular diameters of the workpieces to be straightened.

The invention seeks to shorten the cycle times of this straightening process, whilst at the same time increasing the straightening quality and extending the possible applications of use.

This object is achieved by a device which has the features described in claim 1. Further embodiments of the device according to the invention are described in the sub-claims.

An essential feature of the invention is that the workpiece to be straightened no longer travels along the stationary upper rails by the movement of the lower rails, but that the workpiece is guided between a stationary bearing surface and stationary upper rails which lie opposite said bearing surface in such a manner that the workpiece is disposed between at least two pairs of rollers which are freely rotatable on their axles, the surfaces of the rollers, which form a pair and lie opposite each other with a fixed radial spacing therebetween, form a prismatic two-point support for the workpiece. The movement is effected by the action of an external force upon the axles of the rollers in the axial direction of the compression rails, the workpiece axis lying perpendicularly relative to the direction of travel. In such a case, the rollers roll along the bearing surface by means of frictional contact and likewise, because of their rotational movement, set in rotation the workpiece which lies therebetween by means of the frictional contact, such rollers acting as intermediate wheels and causing the rotational direction to be reversed. Since the workpiece now rotates at the same rolling—i.e. circumferential—speed as the rollers, but in the opposite direction thereto, the arrangement ensures that the workpiece can also simultaneously travel along the upper rails without any slip, thereby being additionally driven by the frictional contact.

Because the workpiece is prismatically gripped between the rollers, the workpiece may be inserted beneath the wedge-shaped inlet of the upper rails without the provision of any other additional means, such as opening upper rails or additionally-driven rams.

Because the spacing between the upper and lower rails continuously decreases in the direction of travel due to the existing wedge-shaped inlet, the workpiece is deflected during its rotation to the extent as fixed by the shortest spacing between the upper and lower rails. Subsequently, the continuous removal of the deflection is effected when this spacing slowly increases again in a wedge-shaped manner in the direction of travel. The deflection is then fully removed by the subsequent wedge-shaped outlet of the upper rails.

Because there are a plurality of identical workpiece gripping devices which are in the form of pairs of rollers and are disposed behind one another with a spacing therebetween and are continuously guided in only one direction between the bearing surface and the upper rails, the essential advantage of the device according to the invention results therefrom, namely that the cycle time is no longer dependent on the length of the travel distance and upon the required auxiliary process times, such as the empty return stroke for example, but the cycle time results solely from the speed of travel and the spacing between the individual workpiece gripping devices.

It is possible, therefore, for a plurality of cycle times to be easily achieved which are shorter than in the known arrangements. A long travel distance which is necessary for good straightening results can easily be achieved also and does not affect the cycle time.

In order to preclude considerable end pressures and consequential damage to the rolling workpieces, the faces of the workpiece which are in contact with the upper rails and the rollers are provided with a slightly convex configuration. An advantageous configuration for the bearing surface is achieved when it is formed from individual guide rails, i.e. lower rails, along which the particular pairs of rollers roll.

In order to permit workpieces having variable lengths and diameters to be straightened and in order also to adapt the number of straightening points, the upper and lower rails are both laterally and vertically adjustable independently of one another, the front edges of the rails and the rear edges of the rails being in turn vertically adjusted independently of one another to permit the wedge angle to be varied for the removal of deflection. The rails may also be laterally inclined at a limited angle to permit the rails to be positioned perpendicularly relative to the deflected axis of the workpiece and consequently to permit the required convex configuration to be kept small.

An advantageous arrangement of the workpiece gripping devices, which comprise the pairs of rollers associated with one another, is achieved when the axles of the individual rollers are rigidly interconnected, but the individual pairs of rollers are adjustable in respect of their axial spacing between one another, and when additional, laterally adjustable, lateral stop members for stopping the workpiece are provided so that a so-called station is formed.

The external force, which serves to guide the stations continuously one behind the other with a spacing therebetween in one direction between the upper rail surface and the bearing surface, is advantageously exerted by at least two endless chains which are disposed with a lateral spacing therebetween and move in synchronism with each other, the individual stations being mounted on said chains one behind the other with a spacing therebetween. Each of the chains is guided by at least two respective guide wheels, at least one of which is driven.

A further significant advantage of the device according to the invention resides in the fact that such a device may also serve in a simple manner to straighten workpieces which do not have uniform diameters at the fixed straightening or supporting points, such as, for example, stepped shafts or axles with long journals. Because the rollers form a prismatic gripping device for gripping the workpiece, additional expensive guide means are not necessary to prevent the workpieces from deflecting obliquely during the rolling movement, caused by the variable rolling circumference, the difference in the circumferential speed being equalised in the form of slip.

In order to preclude the slip, and hence the wear in the case of large differences in diameter, pairs of rollers are provided which do not roll on lower rails but rotate freely and support the straightening points which deviate in respect of diameter; in addition, pairs of rollers may be provided which do not support the workpiece but travel on lower rails to support the stations.

A considerable advantage over the devices of prior art also resides in the fact that, in the device according to the invention, the maximum torque transferable by means of the frictional contact can be significantly increased in a simple manner, i.e. the limit for slipping the workpieces therethrough and hence the possible applications for this method are considerably increased.

Because the pairs of rollers form a prismatic two-point support, the vertical supporting force of the workpiece is split into two radial bearing forces in accordance with the angle formed between the two radial bearing points, the sum of such bearing forces being considerably greater in terms of angle than the vertical force. As a result, the frictional contact between the workpiece and rollers also increases accordingly. To utilise this effect, however, it is necessary to increase accordingly the frictional contact also between the rollers and bearing surfaces. This is easily effected by compression rollers which are additionally provided at the stations and roll along additional upper rails which apply the appropriate pressure.

Furthermore, it is advantageous that, with the device according to the invention, it is easily possible—and in particular without extending the cyle time—to permit automatic measurement monitoring of the straightening result. This is effected, in that a measuring rail is connected to the upper rails in the direction of travel and is spaced from the extended bearing surface at a distance which is variable by overcoming a vertical resilient force but is always parallel. By guiding the workpiece therebeneath, the workpiece travels along this measuring rail in the same way as it travels along the upper rails, an existing residual eccentricity of the workpiece causing a corresponding oscillating vertical movement of the measuring rail, such movement being transferred to a pick-up member known per se.

An important advantage of the device according to the invention resides in the fact that a fully automatic operation is possible in a simple manner. A device is provided in front of the upper rails when viewed in the direction of travel, and the workpieces are automatically removed from such a device in a simple manner through the stations passing therebeneath. In addition, a device is provided behind the rails and removes the workpieces from the passing stations in a simple manner.

The invention is illustrated in the drawings in the form of a plurality of embodiments. In the drawings:

FIG. 1*a* is a schematic, side elevational view of a device in accordance with the prior art on which the invention is based;

FIG. 1*b* is the front view of the device shown in FIG. 1*a;*

Figure 1A:
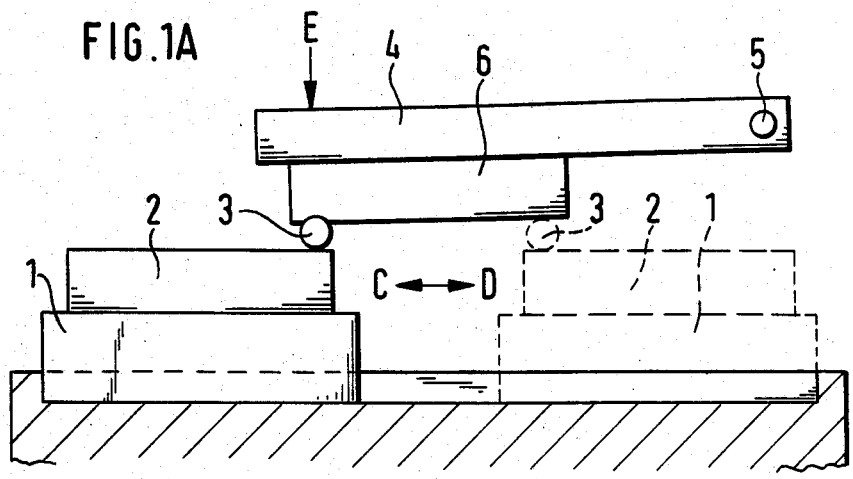
Figure 1B:
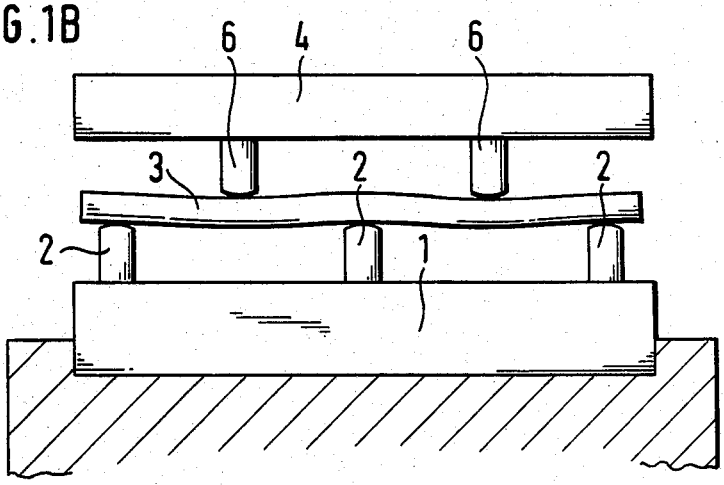

In FIGS. 1*a* and 1*b*, which illustrate a device according to prior art, a carriage 1 has lower rails 2 mounted thereon, and a workpiece 3 to be straightened is disposed on said lower rails 2. Upper rails 6 are secured to an upper plate 4 which is pivotable about a pivot 5. The carriage 1 executes a forward and backward movement in the direction of the arrow C-D. Its initial position is shown on the left-hand side, and its end position is indicated by dotted lines on the right-hand side. The workpiece 3 is inserted between the upper rails 6 and the lower rails 2 when the carriage 1 is in its initial position. Subsequently, the upper plate 4 is pivoted by a set amount in the direction of arrow E, the workpiece being deflected in the illustrated manner. The carriage 1 is then displaced in the direction of arrow D, whereby the workpiece travels between upper and lower rails. Because of the inclination of the uppr rails, the deflection becomes less again towards the end of the stroke. When the carriage is in its end position, the upper plate re-opens; the workpiece 3 may then be removed, and the carriage moves back into its initial position. The invention is based on this prior art.

Figure 2:
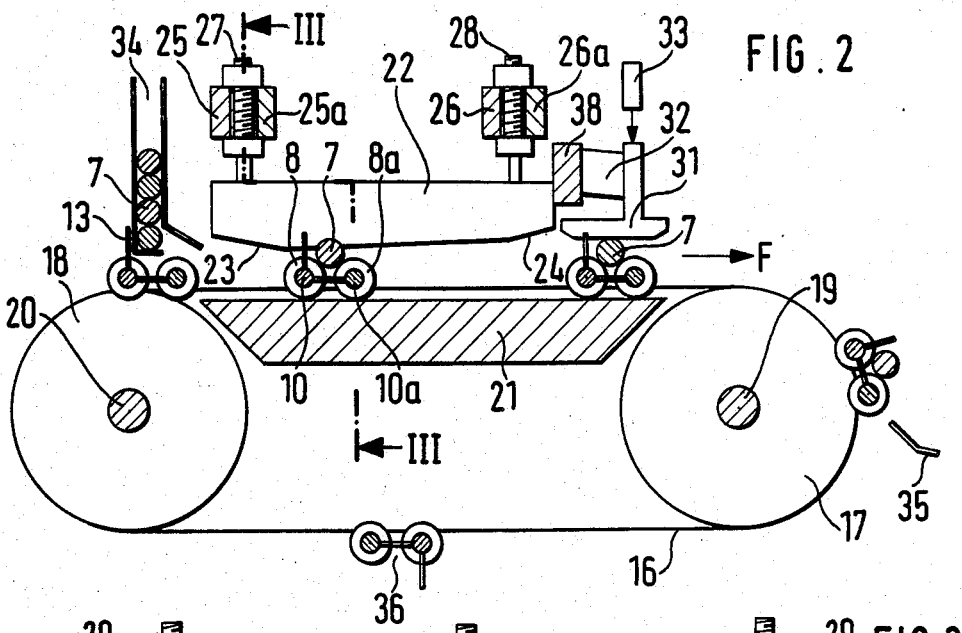
FIG. 2 is a schematic, side elevational view of the device according to the invention.
Figure 3:
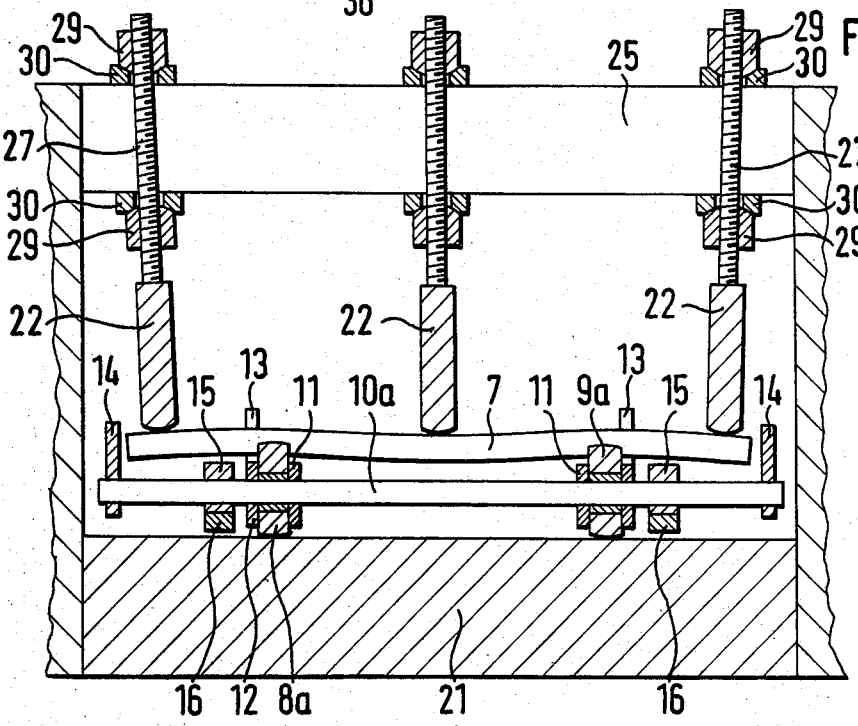
FIG. 3 is a sectional view through FIG. 2, taken along the line III—III.

FIG. 2 is a schematic, side elevational view of the device according to the invention. FIG. 3 is a sectional view through FIG. 2, taken along the line III—III. In this Figure, the workpiece is denoted by the reference numeral 7 and is a simple, smooth shaft in the example illustrated. This workpiece is supported by two pairs of rollers 8;8*a* and 9;9*a*. As can be seen from the drawing, the workpiece is disposed at each end in a respective prismatic two-point support formed by the circumferential faces of the pairs of rollers.

The rollers of each pair correspond to each other and are rotatably mounted on a respective common, continuous axle 10 and 10*a*. The axles 10 and 10*a* , which cooperate with each other, are interconnected, with a fixed radial spacing therebetween, by means of clampable retaining plates 11 and 12 which simultaneously serve to secure the rollers axially. Carrier members 13 are additionally provided on the two outer retaining plates 12. Lateral stop members 14 for stopping the workpieces are clamped to the outer ends of the pairs of axles. Each pair of axles is connected at each end to an endless chain 16 by means of special connection members 15 and is mounted above two respective guide wheels 17 and 18 which are respectively disposed on a common shaft 19 and 20, the front shaft 19 being driven in a manner which is not shown more fully. A plurality of such so-called stations are secured one behind the other on the two chains. The stations are guided by the chains between a lower bearing surface 21 and at least one upper rail 22, three upper rails 22 being provided in the example illustrated.

The upper rails have a wedge-shaped inlet 23 and a likewise wedge-shaped outlet 24. They are mounted on a front portal-shaped double bar 25;25*a* and on a rear portal-shaped double bar 26;26*a* via a respective front threaded spindle 27 and a respective rear threaded spindle 28, the bearing surface between the nut 29 and the base 30 being provided with a spherical configuration to permit the upper rails to be slightly laterally and vertically inclined.

One or more measuring rails 31 are connected to the outlet of the upper rails, and such a measuring rail 31 is secured, by a leaf spring parallelogram 32, to a transverse bar 38 which serves to support the upper rails axially. The measuring rail is retained by the leaf springs at a distance from the extended bearing surface, such a distance always being parallel, but being variable by overcoming the resilient force. The measring rail transfers its vertical movement to a pick-up member 33.

A feed device 34 is disposed in front of the inlet 23, and the workpieces to be straightened are stacked therein. An extraction device is indicated by the reference numeral 35 and is, for example, a simple deflection plate onto which the straightened workpieces drop.

The device which is thus described operates in the following manner:

The chains 16 rotate at a uniform speed in the direction of arrow F and are driven by the front guide wheels 17. The stations 36 are mounted on the chains and are guided beneath the feed device 34. Each workpiece 7 is removed by its particular carrier member 13 and drops between the pairs of rollers 8;8*a* and 9;9*a*. The station with the workpiece is guided by the chains over the bearing surface 21. In such a case, the rollers roll on the bearing surface due to frictional contact and likewise, due to frictional contact, set in rotation through their rotational movement the workpiece which is disposed therebetween, such rollers acting as intermediate wheels and causing the rotational direction to be reversed. When the workpiece arrives beneath the wedge-shaped inlet 23 of the upper rails 22, it now also travels along said rails 22 and is simultaneously deflected at the plastic stress region up to the extent set by the threaded spindles 27 during further forward movement through the reducing spacing between the upper rails and bearing surface. Subsequently, the spacing between the upper rails and bearing surface increases again up to the extent set by the threaded spindles 28. In such a case, a continuous removal of the deflection is effected during the rotational movement at the resilient region. The deflection is then fully removed by the subsequent wedge-shaped outlet.

The stations then pass the measuring rail 31, whereby the workpiece travels along said rail 31 in the same way as it travels along the upper rails. In such a case, the existing residual eccentricity of the workpiece causes an oscillatory vertical movement of the measuring rail, which movement is transferred to a pick-up member 33 known per se and evaluated in a known manner.

When the station 36 turns to a vertical position at the guide wheels 17, the workpiece drops from the station into an extraction device 35, e.g. onto the deflection plate illustrated, where it is then separated by an appropriate separation deflector if the previously measured residual recoil has exceeded the prescribed tolerance limit.

Figure 4:
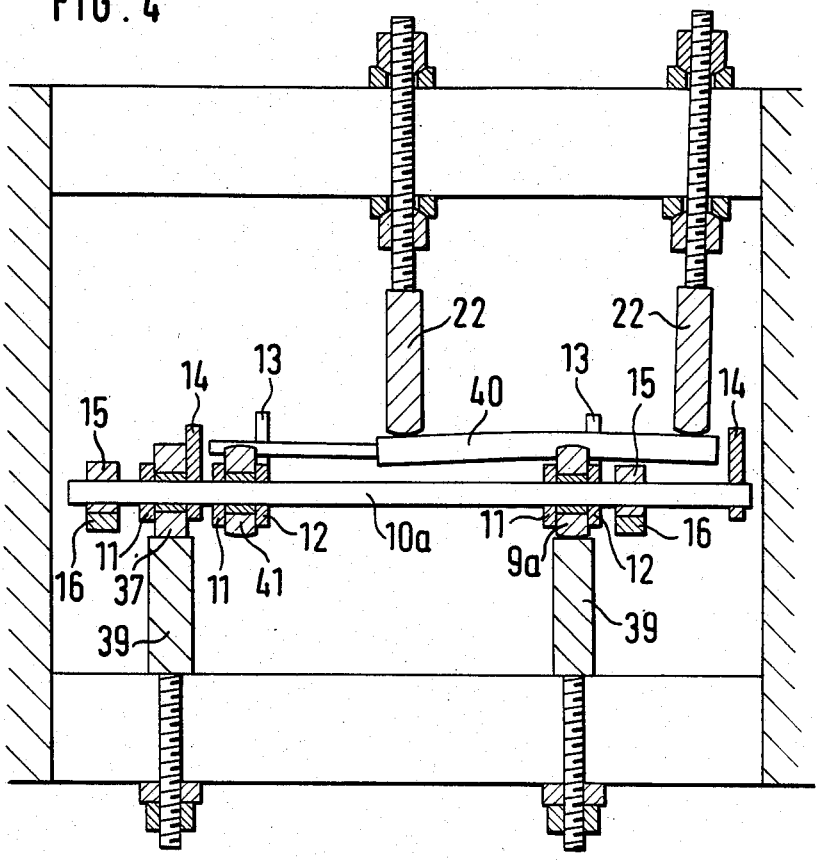
FIG. 4 is a sectional view, like FIG. 3, but showing the lower rails, which serve as the bearing surface, and freely rotating rollers which are additionally provided.

An additional embodiment of the device according to the invention is shown in FIG. 4. Here, the lower bearing surface is formed by individual, laterally adjustable lower rails 39. A workpiece 40 is provided with a journal which has a large diameter difference and is gripped by a pair of rollers 41 which travel freely on the axles and are not supported by lower rails.

With this arrangement it is even possible to straighten in a simple manner workpieces which have a large diameter difference at the fixed straightening points.

The large difference which exists between the rolling speed and the circumferential speed may this be easily nullified by the freely rotating, unsupported pair of rollers 41. In this case, the bearing forces acting on the bearing rail are absorbed by the pair of rollers 37 which are spaced at as short a lateral distance as possible from said pair of rollers 41.

This description clearly reveals the technical advance of the device according to the invention over the known devices of prior art: The cycle times are drastically reduced by a multiple amount, whereby a fully automatic operation is easily possible. At the same time, the attainable straightening quality is considerably increased, and the application limits for the method are extended, all these advantages requiring very little mechanical outlay and fewer component parts which are subject to wear.

I claim:

1. A device for straightening rotationally-symmetrical workpieces, comprising:

at least one stationary bearing means, at least two stationary upper members situated above the stationary bearing means along a longitudinal direction of the bearing means, said stationary upper members being laterally spaced apart from each other, each stationary upper member having inlet and outlet at longitudinal end portions thereof respectively, and a lower point between the inlet and outlet, and at least one supporting means to be moved between the bearing means and upper members, said supporting means including two shafts extending perpendicularly to the longitudinal direction of the upper member and being spaced apart from each other at a predetermined distance and at least one pair of rollers free-rotationally situated on the two shafts respectively, said rollers being located in the center of the two upper members so that when the workpiece is placed on the two rollers, an upper point of the workpiece on the rollers is situated slightly above the lower point of the upper member, whereby when the rollers are moved from a portion adjacent the inlet to a portion adjacent the outlet between the bearing means and the upper members, the workpiece rotates and deforms between the bearing means and the upper members to thereby straighten the workpiece.

2. A device according to claim 1, further comprising means for moving the supporting means between the bearing means and the upper members, said moving means including at least one pair of guide wheels located such that the bearing means is positioned between the guide wheels, two endless belts situated between the guide wheels, power means connected to at least one of the guide wheels, said supporting means being connected to the belts so that when the power means is operated, the belts together with the supporting means move along the guide wheels.

3. A device according to claim 2, wherein each stationary upper member is provided with first means for adjusting laterally and vertically relative to the stationary bearing means so that height between the upper member and the bearing means and lateral position thereof are adjusted.

4. A device according to claim 3, wherein said first adjusting means includes first and second adjusting members situated at the respective longitudinal end portions of the upper member so that heights of the inlet and outlet are independently regulated.

5. A device according to claim 3, wherein said stationary bearing means is provided with second means for adjusting height relative to the stationary upper members.

6. A device according to claim 5, wherein said stationary bearing means is divided into a plurality of lower rails spaced apart from each other, said rollers of the supporting means being situated above the lower rails.

7. A device according to claim 6, wherein said supporting means further includes one pair of additional rollers free-rotationally situated on the two shafts of the supporting means adapted to support a part of the workpiece.

8. A device according to claim 6, wherein said supporting means further includes means for adjusting length between the two shafts of the supporting means.

9. A device according to claim 8, wherein the stationary upper members include lower ends having slightly convex configuration, and the rollers of the supporting means include outer surfaces having slightly convex configuration.

10. A device according to claim 2, further comprising measuring device for measuring size of the workpiece after straightening operation, said measuring device being situated outside the outlet of the upper member.

11. A device according to claim 10, further comprising a feed device adjacent the inlet of the upper member for feeding the workpieces onto the supporting means, and an extraction device adjacent the outlet of the upper member for receiving the workpieces after straightening operation.

* * * * *